US011719428B2

(12) United States Patent
Stoneham

(10) Patent No.: US 11,719,428 B2
(45) Date of Patent: Aug. 8, 2023

(54) COMPRESSIVE HEAT SINK

(71) Applicant: Edward B. Stoneham, Los Altos, CA (US)

(72) Inventor: Edward B. Stoneham, Los Altos, CA (US)

(73) Assignee: XTREMELUX CORPORATION, Campbell, CA (US)

( * ) Notice: Subject to any disclaimer, the term of this patent is extended or adjusted under 35 U.S.C. 154(b) by 30 days.

(21) Appl. No.: 17/604,753

(22) PCT Filed: Apr. 18, 2020

(86) PCT No.: PCT/US2020/028888
§ 371 (c)(1),
(2) Date: Oct. 18, 2021

(87) PCT Pub. No.: WO2020/215042
PCT Pub. Date: Oct. 22, 2020

(65) Prior Publication Data

US 2022/0214033 A1 Jul. 7, 2022

Related U.S. Application Data

(60) Provisional application No. 62/836,086, filed on Apr. 19, 2019.

(51) Int. Cl.

| | |
|---|---|
| ***F21V 29/71*** | (2015.01) |
| ***F21V 19/00*** | (2006.01) |
| ***F21Y 115/10*** | (2016.01) |

(52) U.S. Cl.
CPC ..... *F21V 29/717* (2015.01); *F21V 19/0035* (2013.01); *F21Y 2115/10* (2016.08)

(58) Field of Classification Search
CPC .. F21V 29/717; F21V 29/503; F21V 29/0055; F21V 19/0035; F21Y 2115/10; F21Y 2103/10; F21K 9/90
See application file for complete search history.

(56) References Cited

U.S. PATENT DOCUMENTS

2001/0030037 A1* 10/2001 Hellbruck ..... H01L 23/4093 174/16.3

* cited by examiner

*Primary Examiner* — Anne M Hines
*Assistant Examiner* — Jose M Diaz

(57) ABSTRACT

A heat-sink assembly is configured with two parts to grip a light-emitting element and produce a transverse force urging a surface of the light-emitting element toward a surface of the heat-sink assembly, which conducts heat away from the light-emitting element. Fastening mechanisms and a fulcrum inter-connect the heat-sink parts and produce the force that grips the light-emitting element. A configuration of the heat-sink parts creates a semi-enclosed space accessible through a gap. A configuration of elastomeric gaskets within the semi-enclosed space protects a portion of the space from intrusion of liquids or other environmental influences. Configuration of the heat-sink parts to form a recess in the heat-sink assembly provides protection of the light-emitting element from mechanical damage, and the recess may contain transparent materials that further protect the light-emitting element from detrimental environmental influences.

16 Claims, 10 Drawing Sheets

COMPRESSIVE HEAT SINK

RELATED APPLICATIONS

This application claims the benefit of U.S. Provisional Application No. 62/836,086, with filing date Apr. 19, 2019, which application is incorporated herein by reference in its entirety for all purposes.

BACKGROUND

Heat sink generally refers to a thermally conductive structure that removes heat from a heat-generating element and transfers it to a thermal reservoir such as the ambient atmosphere, a pool of water, the earth, or outer space. Light-emitting elements, such as light-emitting diodes (LEDs) or semiconductor lasers, being less than 100-percent efficient, generate heat as well as light, and the generated heat must be removed to prevent the light-emitting element from overheating and consequently suffering loss of efficiency or a reduction in operating lifetime. Heat removal through radiation or through thermal convection from some light-emitting elements including LEDs and semiconductor lasers is not sufficient in most practical applications, and the use of a heat sink is generally required. The heat sink is most commonly constructed of a metal, such as aluminum, that is high in thermal conductivity, low in cost, and light in weight.

Heat is removed from the light-emitting element through a thermal interface between the light-emitting element and the heat sink. Generally, the light-emitting element has a thermal-interface surface that is pressed against a heat-extraction surface of the heat sink in order to generate sufficient thermal contact. Frequently, a formable thermally conductive material is included in the interface to improve the thermal contact and further facilitate heat flow from the light-emitting element into the heat sink.

The heat sink conducts the heat away from the interface and to various extremities, such as fins with large surface area to allow convective transfer of heat to the reservoir, which in most applications is the ambient air.

In practical applications a light-emitting element is frequently included as part of a fixture. The fixture is an assembly that may include such other items as a heat sink, a support or mount for the light-emitting element, items or features that provide mechanical or environmental protection of the light-emitting element, electronic circuitry used to supply power to the light-emitting element, an enclosure to house and protect the electronic circuitry, features to allow electrical interconnections between the electronic circuitry and the light-emitting element, and/or items or features designed to protect humans from electric shock.

SUMMARY

A heat-sink assembly for removing heat from a light-emitting element is described.

In an example, a heat-sink assembly comprises two heat-sink elements that grip opposite edges of a light-emitting element with a compressive force and convert the compressive force into a transverse force that presses the thermal-interface surface of the light-emitting element against a heat-extraction surface of the heat-sink assembly.

In this example, the heat-sink elements are in contact with each other at a fulcrum about which the two elements can pivot with respect to each other, and a fastening mechanism located between the fulcrum and the light-emitting element applies compressive force drawing the two heat-sink elements together to grip the light-emitting element.

The heat-sink elements in this example are shaped to form a semi-enclosed space to house electrical circuitry, and a gap between the heat-sink elements allows the passage of electrical conductors, such as wires, from the light-emitting element outside of the semi-enclosed space to the electrical circuitry inside the semi-enclosed space. A gasket assembly is described that, acting in conjunction with the heat-sink elements in this example, helps to protect the electrical circuitry inside the semi-enclosed space from intrusion of liquids or other environmental influences.

Additional features of the heat-sink elements in this example create a recess within which the light-emitting element is situated and protected from some common sources of mechanical damage. The recess creates a convenient cavity to contain or support optically transparent materials, such as glass, plastic, or an optical potting compound, that can further protect the light-emitting element or shape the pattern of light that is emitted.

DETAILED DESCRIPTION OF VARIOUS EMBODIMENTS

A compressive heat sink will become better understood through review of the following detailed description in conjunction with the drawings. The detailed description and drawings provide examples of the various embodiments described herein. Those skilled in the art will understand that the disclosed examples may be varied, modified, and altered without departing from the scope of the disclosed structures. Many variations are contemplated for different applications and design considerations; however, for the sake of brevity, not every contemplated variation is individually described in the following detailed description.

Examples of a compressive heat sink are now described in more detail with reference to FIGS. 1-11. In the various figures, like or similar features may have the same reference labels.

Figure 1:
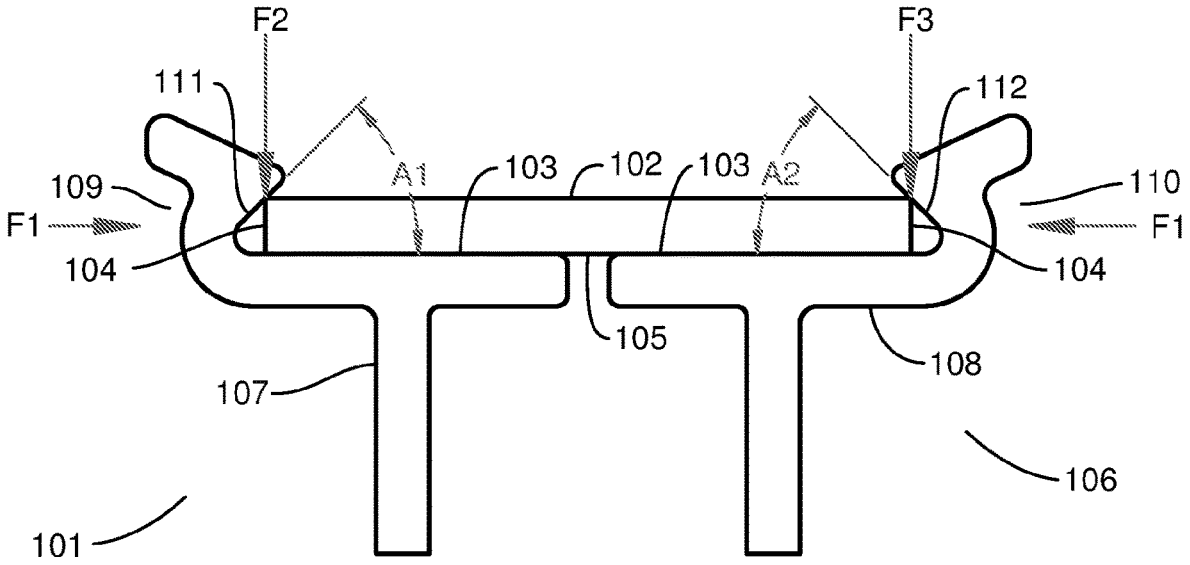
FIG. 1 is a cross-sectional drawing illustrating an example of a compressive force redirection mechanism forcing a light-emitting element against a heat sink surface.

FIG. 1 is a cross-sectional drawing illustrating an example of a compressive force redirection mechanism 101 forcing a light-emitting element 102 against one or more heat-extraction surfaces 103. Light-emitting element 102 may have edges 104 and a thermal interface surface 105. A heat-sink assembly 106 may include heat-sink elements 107 and 108, which may include force redirectors 109 and 110 respectively that may be capable of redirecting a compressive force F1 applied by the heat-sink elements to the edges 104 of light-emitting element 102 into transverse forces F2 and F3 that force the light-emitting element thermal interface surface 105 into contact with the one or more heat-extraction surfaces 103. In the example shown, the redirectors 109 and 110 consist of inclined planes 111 and 112. The angles A1 and A2 of the inclined planes 111 and 112 respectively may largely determine the ratio of each of the transverse forces F2 and F3 to the compressive force F1.

Figure 2:
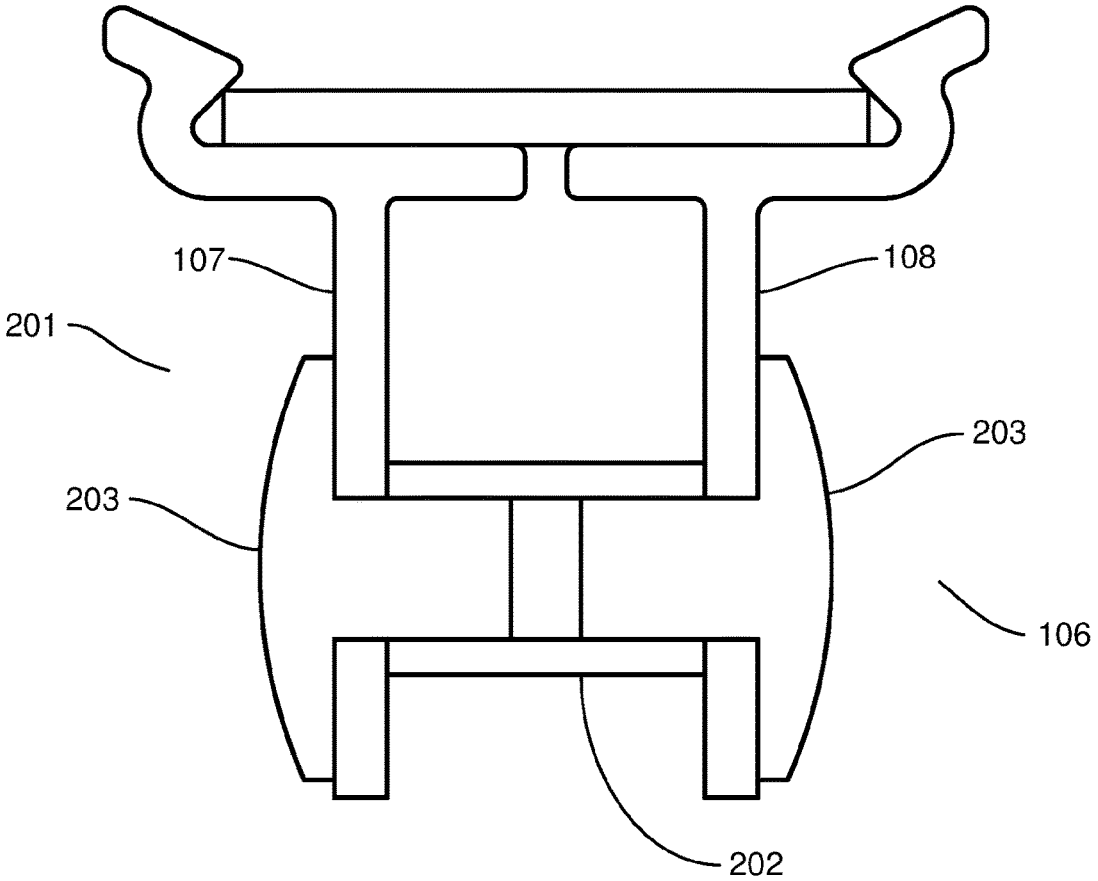
FIG. 2 shows an example of a heat-sink assembly having fasteners that provide the compressive force.

Any of a variety of mechanisms may be used to supply the compressive force F1. FIG. 2 shows in cross section an example of a heat-sink assembly 106 in which compressive-force-producing mechanism 201 includes a threaded stand-off 202 and two screws 203. In the drawing, for simplicity, the threads are not explicitly shown. Alternative compressive-force-producing mechanisms that will be familiar to those skilled in the art may include without limitation, for example, a spacer with a screw and a nut, a spacer and a rivet, an external clamp, or spring forces provided by the heat-sink elements 107 and 108 themselves.

Figure 3:
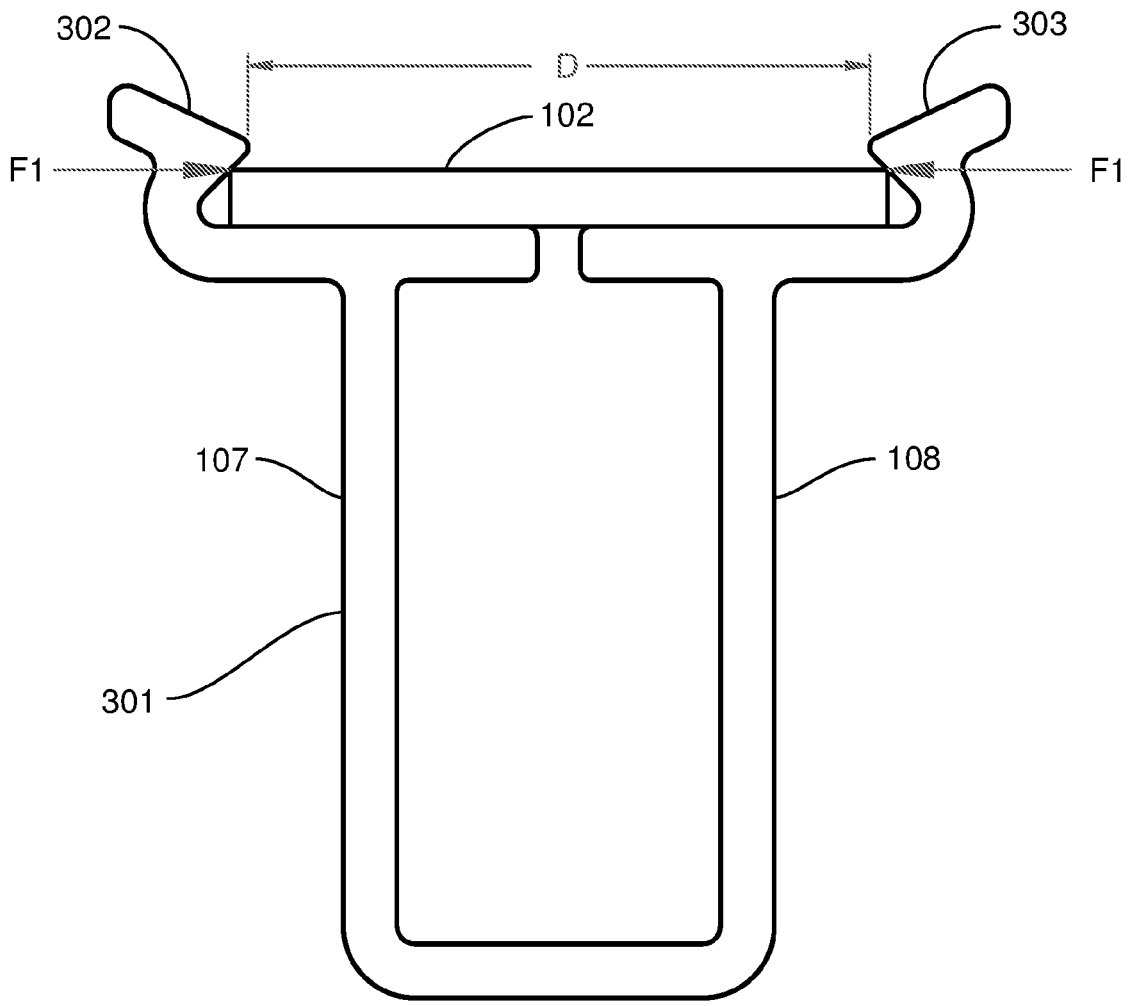
FIG. 3 shows how spring forces in an exemplary heat-sink assembly constructed of continuous unitary material apply the compressive force.

FIG. 3 shows an exemplary heat-sink assembly 301 in which the heat-sink elements 107 and 108 are portions of a continuous unitary material and apply spring forces to create the compressive force F1. The ends 302 and 303 of heat-sink elements 107 and 108 respectively are spread apart (to distance D) from their relaxed positions (normally less than distance D apart) in order to accommodate light-emitting element 102. The consequent restoring force is the spring force that creates compressive force F1.

Figure 4:
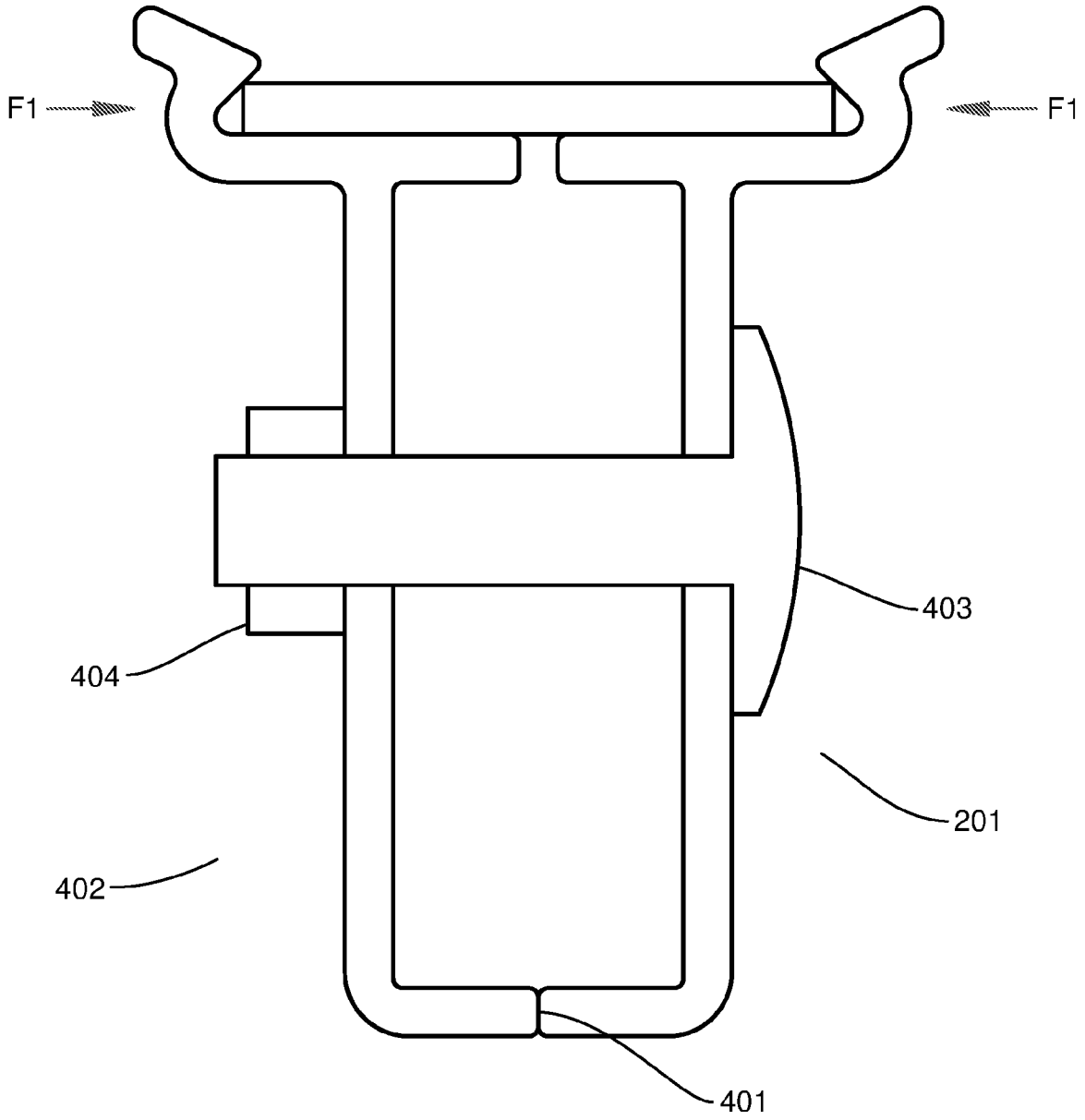
FIG. 4 shows an exemplary heat-sink assembly having a fulcrum that results in an enhanced compressive force.

As shown in an exemplary cross section in FIG. 4, a fulcrum 401 may be included as part of an extended mechanism 402 for producing compressive force F1. Fulcrum 401, in conjunction with compressive-force-producing mechanism 201, exemplified by a screw 403 and nut 404 in FIG. 4, may produce a greater compressive force F1 than can be produced by compressive-force-producing mechanism 201 acting alone as in FIG. 2.

Figure 5:
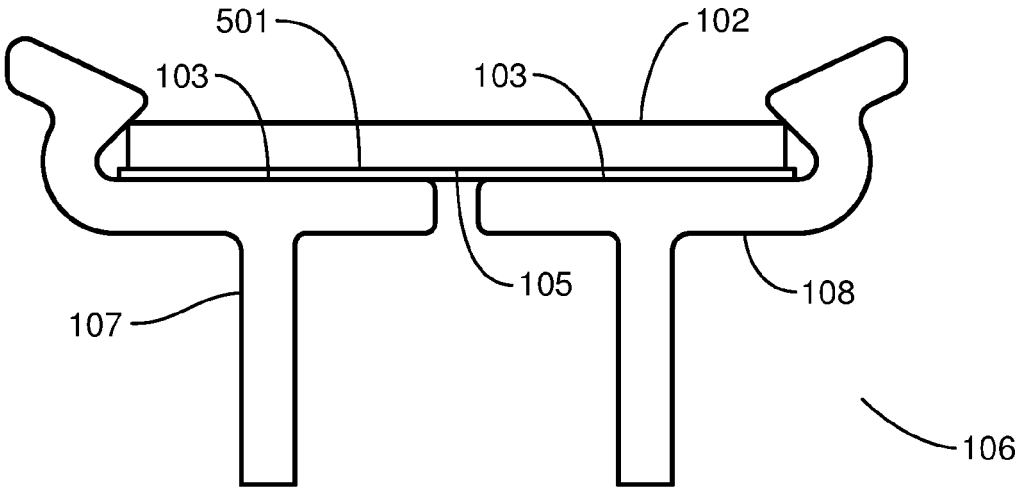
FIG. 5 shows an exemplary heat-sink assembly having a thermal transfer medium between the thermal-interface surface of the light-emitting element and the heat-extraction surface of the heat-sink assembly.

As shown in the cross section of an exemplary heat-sink assembly 106 in FIG. 5, a thermal transfer medium 501 may be included between the thermal interface surface 105 of light-emitting element 102 and the one or more heat-extraction surfaces 103. Examples of such a thermal transfer medium 501 may include without limitation heat-sink grease, a thermally-conductive elastomer, a solidified thermal compound that may be applied as a liquid and cured, a layer of B-staged thermally-conductive material, thermally-conductive tape, a deformable metal, solder or brazing material, or a combination of any such media.

Figure 6A:
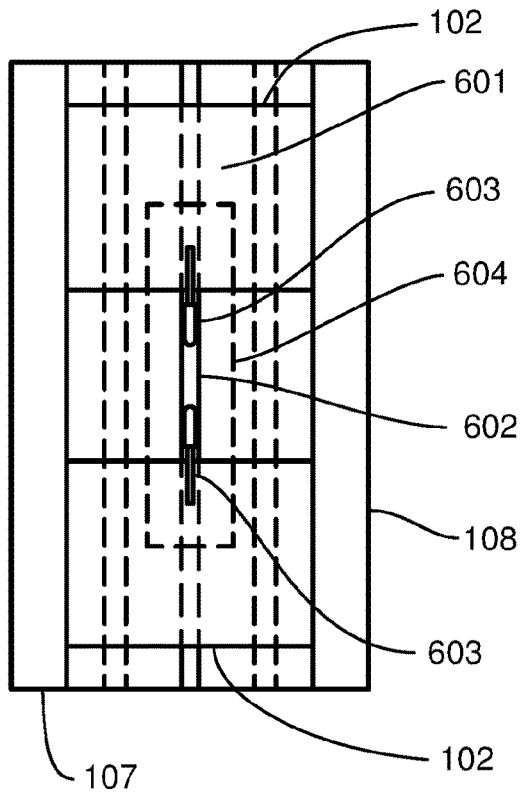
FIG. 6A is a view from the top of an exemplary heat-sink assembly having electrical conductors emerging from a semi-enclosed space and connecting to the light-emitting element.
Figure 6B:
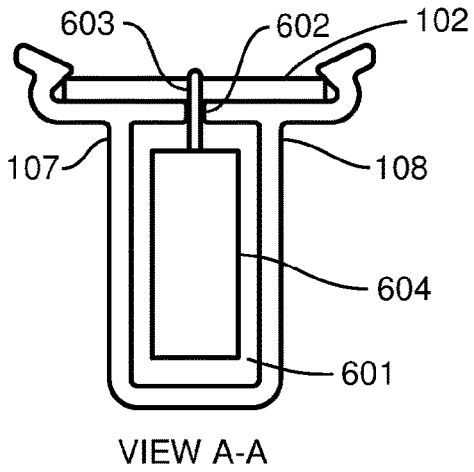
FIG. 6B is a cross-sectional view at the middle of the example in FIG. 6A, with the position of the cross section being indicated in FIG. 6C.
Figure 6C:
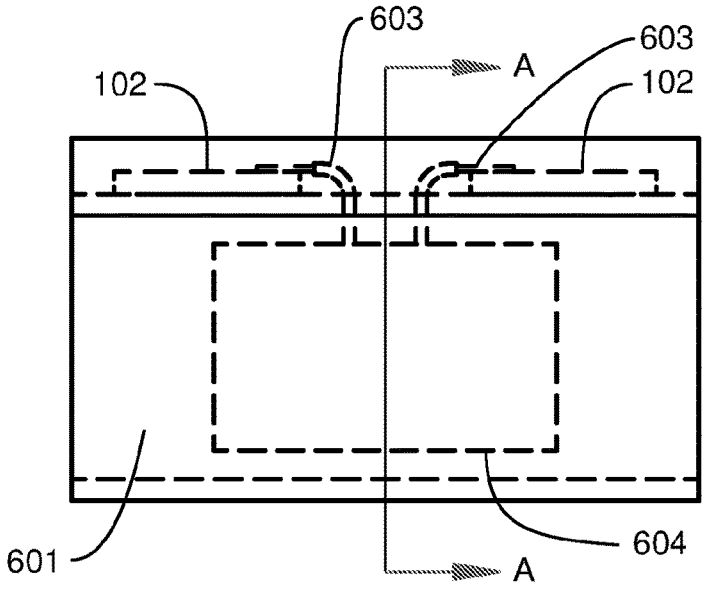
FIG. 6C is a view from the side of the example in FIG. 6A.
Figure 7:
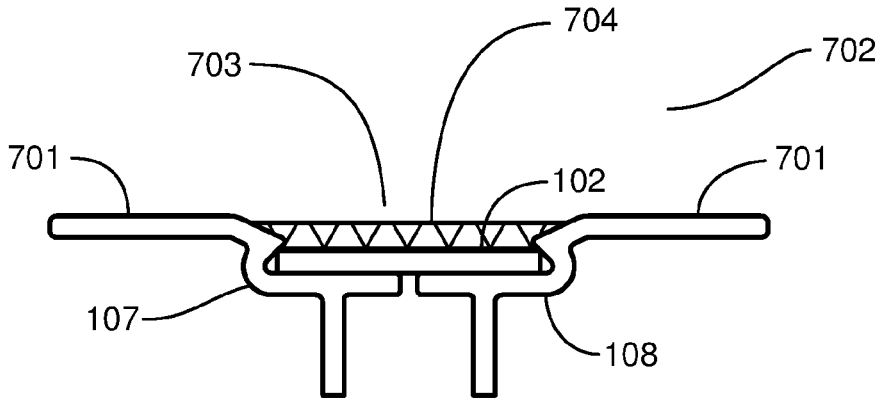
FIG. 7 shows in cross section an exemplary heat-sink assembly configured to accept an optically transparent coating over a light-emitting element for protecting the light-emitting element from mechanical damage.

A semi-enclosed space 601 shown in FIGS. 6A, 6B, and 6C may be bounded by heat sink elements 107 and 108. The three views in FIGS. 6A, 6B, and 6C show how a gap 602 between heat-sink elements 107 and 108 may allow one or more electrical conductors 603 to pass from one or more light-emitting elements 102 situated outside a semi-enclosed space 601 to internal circuitry 604 situated inside semi-enclosed space 601. The one or more electrical conductors 603 may include without limitation, for example, one or more electrically insulated or uninsulated wires, one or more printed circuit boards, one or more flexible printed circuits, and/or one or more pieces of patterned sheet metal.

Heat-sink elements 107 and 108 may include features that may serve to protect light-emitting element 102 from possible mechanical damage and/or from degradation by environmental factors such as water and dust. As shown in the exemplary heat-sink assembly in FIG. 7, lateral fins 701, which may contribute to the transfer of heat to the surrounding atmosphere 702, may be attached to or included as parts of heat-sink elements 107 and/or 108 and may be shaped to create a recess 703 that prevents flat objects or large rounded objects from mechanically contacting light-emitting element 102. Recess 703 may also serve to partially contain an optically transmissive material 704 that may serve to further protect light-emitting element 102 mechanically and to prevent environmental dust or liquids from contacting or degrading light-emitting element 102. The optically transmissive material 704 may include without limitation, for example, a silicone or other transparent elastomer that may be poured into recess 703 and then cured to form a solid.

Figure 8A:
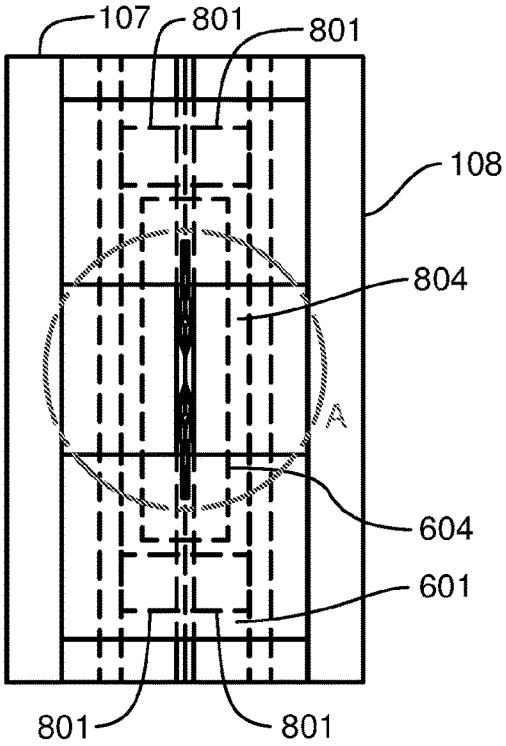
FIG. 8A is a view from the top of an example of a heat-sink assembly having one or more gaskets incorporated within a semi-enclosed space formed by elements of the heat-sink assembly, which gaskets serve to protect contents from intrusion of such items as dust or liquids.
Figure 8B:
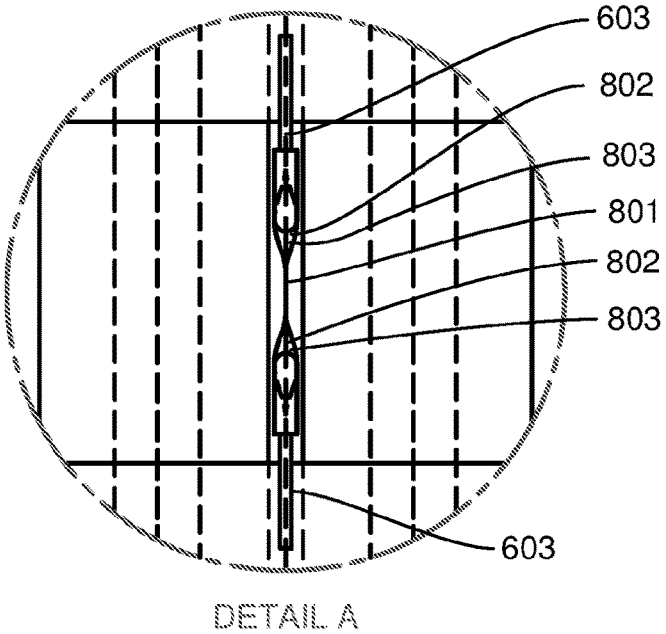
FIG. 8B is an enlarged view of the circled portion of the view in FIG. 8A.
Figure 8C:
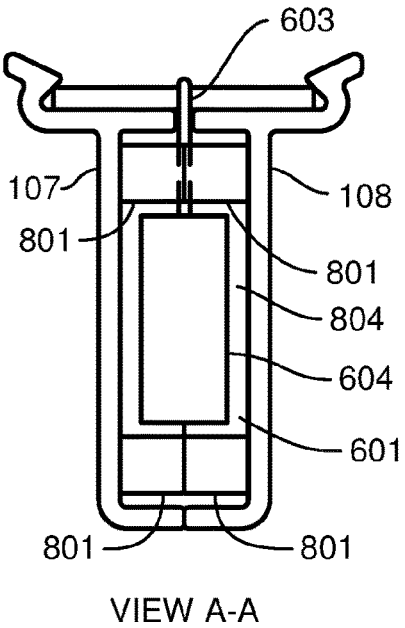
FIG. 8C is a cross-sectional view at the middle of the example in FIG. 8A, with the position of the cross section being indicated in FIG. 8D.
Figure 8D:
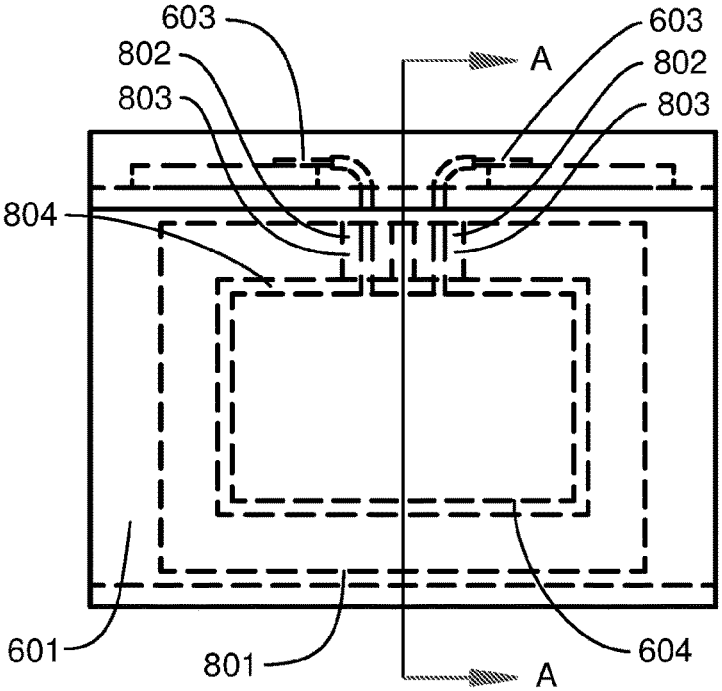
FIG. 8D is a view from the side of the example in FIG. 8A.

As shown in the three views and one detail of an exemplary heat-sink assembly in FIGS. 8A, 8B, 8C, and 8D, semi-enclosed space 601 may include one or more gaskets 801 that may serve to protect internal circuitry 604 from environmental influences, such as water or dust. The one or more electrical conductors 603 may pass through a space 802 between gaskets 801 as shown in FIGS. 8B and 8D or may pass through a space (not shown) between a gasket 801 and a surface of one of the heat-sink elements 107 and 108. If the one or more gaskets 801 are made of a conformable material such as, but not limited to, a silicone foam material, the space 802 may be of limited extent and may be filled with a sealant material 803 such as, but not limited to, a silicone sealant applied as a liquid and subsequently cured to form a solid. Sealant material 803 may engulf the one or more electrical conductors 603 and fill the entire space 802 thereby preventing or impeding the flow of dust, liquids, or other environmental factors through space 802 into the space 804 occupied by internal circuitry 604.

Figure 9:
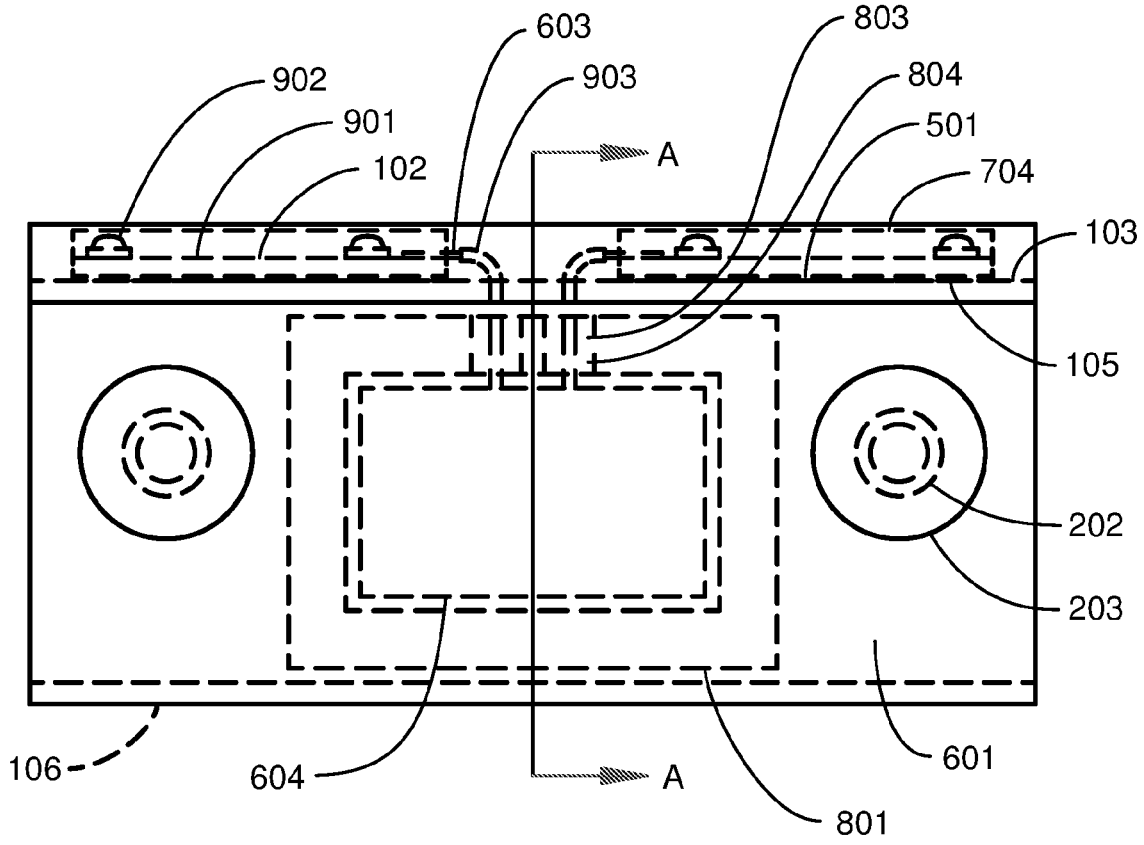
FIG. 9 shows a side view of a further example of a heat-sink assembly.
Figure 10:
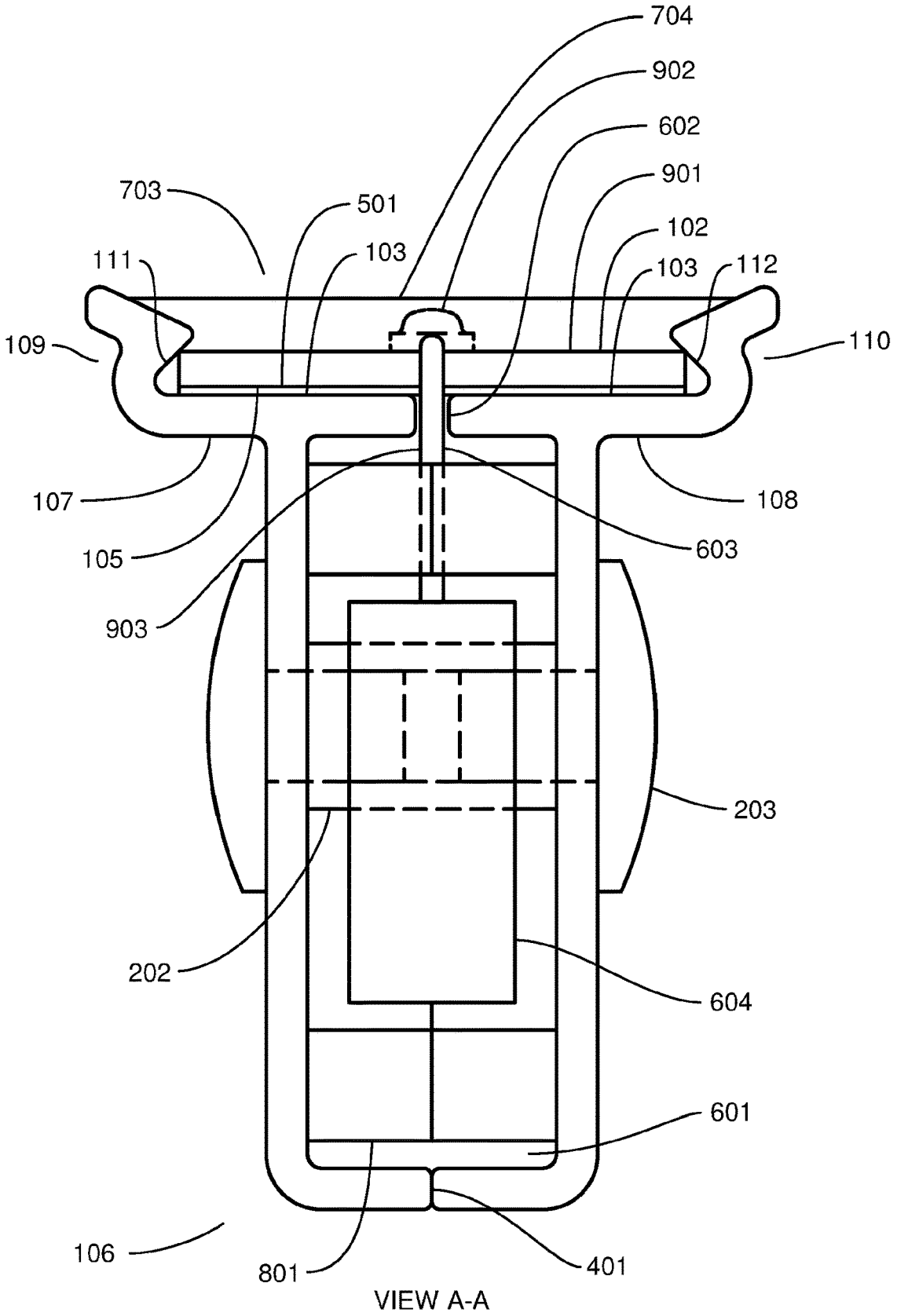
FIG. 10 shows View A-A (as defined in FIG. 9) of the heat-sink assembly shown in FIG. 9.
Figure 11:
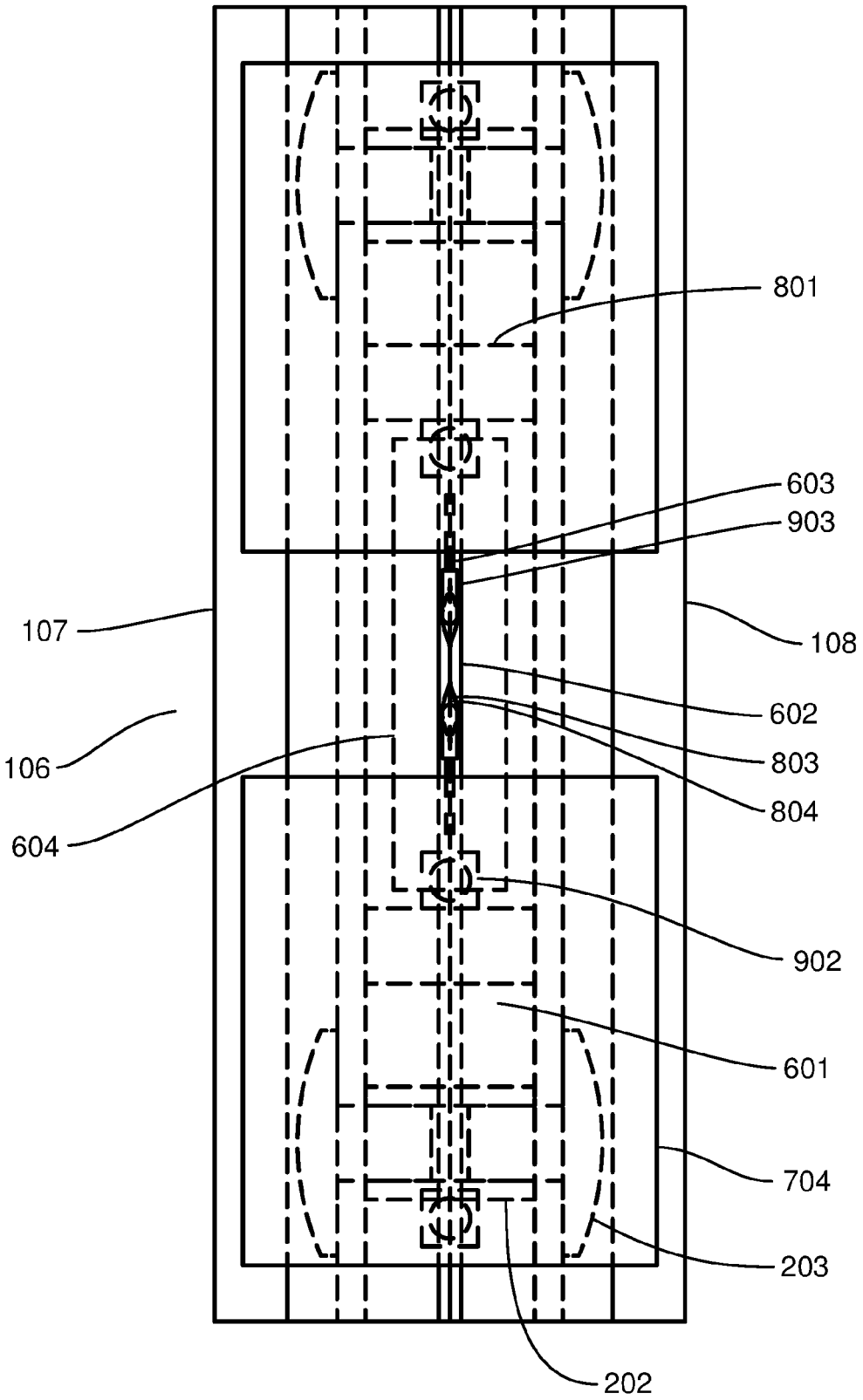
FIG. 11 shows a top view of the heat-sink assembly shown in FIG. 9.

A further example of a heat-sink assembly is shown in FIG. 9 in a side view, in FIG. 10 in a view A-A (defined in FIG. 9), and in FIG. 11 in a top view. Light-emitting element 102 in the further example may include a circuit board 901 with one or more LEDs 902 attached to it. Heat-sink assembly 106 in the further example may comprise two heat-sink elements 107 and 108 shaped as extrusions of identical cross section. The heat-sink elements 107 and 108 in the further example may be shaped to include force-redirection mechanisms 109 and 110 respectively including inclined planes 111 and 112 respectively forcing the thermal interface surface 105 of light-emitting element 102 into contact with heat-extraction surfaces 103. The shape of heat-sink elements 107 and 108 in the further example may be such that the combination of the two in heat-sink assembly 106 may include a fulcrum 401, a gap 602, a recess 703, and a semi-enclosed space 601. Screws 203 in the further example may attach heat-sink elements 107 and 108 respectively to standoffs 202 situated within semi-enclosed space 601. Thermal transfer medium 501 in the further example may be included between the thermal interface surface 105 of light-emitting element 102 and the heat-extraction surfaces 103. Electrical conductors 603 in the further example may consist of insulated wires 903 each electrically connected at one end to light-emitting elements 102, passing through gap 602, and electrically connected at the opposite end to internal circuitry 604 situated within semi-enclosed space 601. Gaskets 801 in the further example may be attached to heat-sink elements 107 and 108 and may extend into semi-enclosed space 601 far enough to mate against one another. Insulated wires 903 in the further example may pass between mating gaskets 801, and the space 803 the wires create between the mating gaskets may be filled with the sealant material 804 consisting of a viscous silicone sealant material applied as a liquid and subsequently cured to form an elastomeric solid. An optically transmissive material 704, such as a silicone potting material or moldable silicone material, in the further example may be included over light-emitting elements 102.

Accordingly, while embodiments have been particularly shown and described, many variations may be made therein. Other combinations of features, functions, elements, and/or properties may be used. Such variations, whether they are directed to different combinations or directed to the same combinations, whether different, broader, narrower, or equal in scope, are also included.

A1. A heat-sink assembly for removing heat from a light-emitting element, the light-emitting element having a thermal-interface surface, a first edge, and a second edge, the first edge and the second edge being on respective spaced-apart portions of the light-emitting element and the thermal-interface surface extending at least partially between the first and second edges, the heat-sink assembly comprising:

a heat-sink element composed of a solid material;

a heat-extraction surface thermally connected to the heat-sink element;

a force redirection mechanism configured to convert to a transverse force a compressive force applied through the action of the heat-sink element pushing the force redirection mechanism in a first direction against the first edge of the light-emitting element, the transverse force acting on the light-emitting element in a second direction transverse to the first direction, the transverse force causing the thermal-interface surface of the light-emitting element to press toward the heat-extraction surface; and a restraining element acting on the second edge of the light-emitting element to resist the compressive force.

A2. The heat-sink assembly of paragraph A1, wherein the heat-extraction surface is planar and wherein the force-redirection mechanism includes an inclined surface portion configured to be in contact with the first edge of the light-emitting element and inclined so that a first force applied by the inclined surface portion to the first edge of the light-emitting element and directed parallel to the heat-extraction surface results in a second force pressing the thermal-interface surface of the light-emitting element toward the heat-extraction surface.

A3. The heat-sink assembly of paragraph A1, further including a fastening mechanism supported relative to the heat-sink element, and configured to urge the heat-sink element toward the restraining element by tightening and produce the compressive force when the fastening mechanism is tightened.

A4. The heat-sink assembly of paragraph A3, further including a spacer, the spacer being a solid element or assembly situated between the heat-sink element and the restraining element and serving to limit the degree to which the fastening mechanism is able to cause bending of the heat-sink element or the restraining element.

A5. The heat-sink assembly of paragraph A1, wherein the heat-sink element and the restraining element are portions of a continuous unitary material and apply the compressive force through spring forces.

A6. The heat-sink assembly of paragraph A1, further including a compressive fastener contacting the heat-sink element and the restraining element at locations no greater than a first distance from the light-emitting element, the heat-sink element and the restraining element contacting each other at locations no less than the first distance from the light-emitting element, the compressive fastener forcing the heat-sink element and the restraining element toward each other to apply the compressive force.

A7. The heat-sink assembly of paragraph A1, wherein a thermally conductive medium, which may be solid or liquid, disposed between and conforming to portions of the thermal-interface surface and the heat-extraction surface acts to conduct heat from the thermal-interface surface to the heat-extraction surface.

A8. The heat-sink assembly of paragraph A1, wherein the shapes of the heat-sink element and the restraining element define a recess sized to accept the light-emitting element and prevent mechanical contact between sensitive portions of the light-emitting element and planar surfaces external to the recess.

A9. The heat-sink assembly of paragraph A8, wherein optically transmissive solid material is included in the recess, the solid material being configured as a barrier capable of resisting intrusion, onto sensitive portions of the light-emitting element, of dust or of liquid or of mechanical influences originating outside the recess.

A10. The heat-sink assembly of paragraph A8, wherein optically transmissive solid material is included in the recess, the solid material forming a seal over portions of the light-emitting element, which seal resists ingression of dust or of a liquid or of a gas from outside of the recess to the surface of the light-emitting element.

A11. The heat-sink assembly of paragraph A1, wherein the heat-sink element and the restraining element together bound a semi-enclosed interior space within which there exists at least one point distant from the nearest surface of the heat-sink element and equally distant from the restraining element, at which point the combined surface, comprising the set-theoretic union of all points on the surface of the heat-sink element and all points on the surface of the restraining element, subtends a total of at least nine steradians of solid angle.

A12. The heat-sink assembly of paragraph A11, wherein the semi-enclosed interior space includes a gasket assembly and a protected space, the gasket assembly comprising one or more elastomeric gaskets, the gasket assembly contacting and extending between the heat-sink element and the restraining element, the configuration of which gasket assembly is such that the gasket assembly resists ingression of dust or of a liquid or of a gas into the protected space.

A13. The heat-sink assembly of paragraph A12, wherein the gasket assembly includes a deformation gap between two gaskets or between a gasket and a surface of the heat-sink element or between a gasket and a surface of the restraining element, the deformation gap being a separation between a gasket surface and a surface that the gasket surface would be touching if the gasket surface were not deformed relative to a simpler shape, which deformation gap is filled with one or more materials that resist ingression of dust or of a liquid or of a gas into the protected space.

A14. The heat-sink assembly of paragraph A1, wherein the heat-sink element has the form of a solid elongated in a direction of elongation, the solid having a first length in the direction of elongation and a first cross section in a plane perpendicular to the direction of elongation, the first cross section being constant over most of the first length.

A15. The heat-sink assembly of paragraph A14, wherein the restraining element has the form of a solid elongated in a direction of elongation, the solid having a second length in the direction of elongation and a second cross section in a plane perpendicular to the direction of elongation, the second cross section being constant over most of the second length.

A16. The heat-sink assembly of paragraph A15, wherein the first cross section is identical to the second cross section.

INDUSTRIAL APPLICABILITY

The methods and apparatus described in the present disclosure are applicable to the general lighting industry, the decorative lighting industry, the specialty lighting industry, the agricultural lighting industry, the horticultural lighting industry, the research lighting industry, the military lighting industry, and all other industries in which LEDs or other electrically-powered sources are employed to produce light. They are also applicable to other industries in which heat is to be removed from heat-generating elements outside of an enclosure connected electrically to electrical circuitry inside the enclosure.

What is claimed is:

1. A heat-sink assembly for removing heat from a light-emitting element, the light-emitting element having a thermal-interface surface, a first edge, and a second edge, the first edge and the second edge being on respective spaced-apart portions of the light-emitting element and the thermal-interface surface extending at least partially between the first and second edges, the heat-sink assembly comprising:

a heat-sink element composed of a solid material;

a heat-extraction surface thermally connected to the heat-sink element;

a force redirection mechanism configured to convert to a transverse force a compressive force applied through the action of the heat-sink element pushing the force redirection mechanism in a first direction against the first edge of the light-emitting element, the transverse force acting on the light-emitting element in a second direction transverse to the first direction, the transverse force causing the thermal-interface surface of the light-emitting element to press toward the heat-extraction surface; and a restraining element acting on the second edge of the light-emitting element to resist the compressive force;

characterized in that the heat-sink assembly includes a mechanism for continually maintaining the compressive force.

2. The heat-sink assembly of claim 1, wherein the heat-extraction surface is planar and wherein the force-redirection mechanism includes an inclined surface portion configured to be in contact with the first edge of the light-emitting element and inclined so that a first force applied by the inclined surface portion to the first edge of the light-emitting element and directed parallel to the heat-extraction surface results in a second force pressing the thermal-interface surface of the light-emitting element toward the heat-extraction surface.

3. The heat-sink assembly of claim 1, further including a fastening mechanism supported relative to the heat-sink element, and configured to urge the heat-sink element toward the restraining element by tightening and produce the compressive force when the fastening mechanism is tightened.

4. The heat-sink assembly of claim 3, further including a spacer, the spacer being a solid element or assembly situated between the heat-sink element and the restraining element and serving to limit the degree to which the fastening mechanism is able to cause bending of the heat-sink element or the restraining element.

5. The heat-sink assembly of claim 1, wherein the heat-sink element and the restraining element are portions of a continuous unitary material and apply the compressive force through spring forces.

6. The heat-sink assembly of claim 1, further including a compressive fastener contacting the heat-sink element and the restraining element at locations no greater than a first distance from the light-emitting element, the heat-sink element and the restraining element contacting each other at locations no less than the first distance from the light-emitting element, the compressive fastener forcing the heat-sink element and the restraining element toward each other to apply the compressive force.

7. The heat-sink assembly of claim 1, wherein a thermally conductive medium, which may be solid or liquid, disposed between and conforming to portions of the thermal-interface surface and the heat-extraction surface acts to conduct heat from the thermal-interface surface to the heat-extraction surface.

8. The heat-sink assembly of claim 1, wherein the shapes of the heat-sink element and the restraining element define a recess sized to accept the light-emitting element and prevent mechanical contact between sensitive portions of the light-emitting element and planar surfaces external to the recess.

9. The heat-sink assembly of claim 8, wherein optically transmissive solid material is included in the recess, the solid material being configured as a barrier capable of resisting intrusion, onto sensitive portions of the light-emitting element, of dust or of liquid or of mechanical influences originating outside the recess.

10. The heat-sink assembly of claim 8, wherein optically transmissive solid material is included in the recess, the solid material forming a seal over portions of the light-emitting element, which seal resists ingression of dust or of a liquid or of a gas from outside of the recess to the surface of the light-emitting element.

11. The heat-sink assembly of claim 1, wherein the heat-sink element and the restraining element together bound a semi-enclosed interior space within which there exists at least one point distant from the nearest surface of the heat-sink element and equally distant from the restraining element, at which point the combined surface, comprising the set-theoretic union of all points on the surface of the heat-sink element and all points on the surface of the restraining element, subtends a total of at least nine steradians of solid angle.

12. The heat-sink assembly of claim 11, wherein the semi-enclosed interior space includes a gasket assembly and a protected space, the gasket assembly comprising one or more elastomeric gaskets, the gasket assembly contacting and extending between the heat-sink element and the restraining element, the configuration of which gasket assembly is such that the gasket assembly resists ingression of dust or of a liquid or of a gas into the protected space.

13. The heat-sink assembly of claim 12, wherein the gasket assembly includes a deformation gap between two gaskets or between a gasket and a surface of the heat-sink element or between a gasket and a surface of the restraining element, the deformation gap being a separation between a gasket surface and a surface that the gasket surface would be touching if the gasket surface were not deformed relative to a simpler shape, which deformation gap is filled with one or more materials that resist ingression of dust or of a liquid or of a gas into the protected space.

14. The heat-sink assembly of claim 1, wherein the heat-sink element has the form of a solid elongated in a direction of elongation, the solid having a first length in the direction of elongation and a first cross section in a plane perpendicular to the direction of elongation, the first cross section being constant over most of the first length.

15. The heat-sink assembly of claim 14, wherein the restraining element has the form of a solid elongated in a direction of elongation, the solid having a second length in the direction of elongation and a second cross section in a plane perpendicular to the direction of elongation, the second cross section being constant over most of the second length.

16. The heat-sink assembly of claim 15, wherein the first cross section is identical to the second cross section.

* * * * *